US006773006B2

(12) United States Patent
Andreyka et al.

(10) Patent No.: US 6,773,006 B2
(45) Date of Patent: Aug. 10, 2004

(54) PNEUMATIC APPARATUS WITH REMOVABLE VACUUM SHOE

(75) Inventors: James B. Andreyka, Monroe, CT (US); Jeffrey L. Chodack, New Milford, CT (US); Shahzad H Malick, Fairfield, CT (US); Boris Rozenfeld, New Milford, CT (US); John W. Sussmeier, Cold Spring, NY (US)

(73) Assignee: Pitney Bowes Inc., Stamford, CT (US)

( * ) Notice: Subject to any disclaimer, the term of this patent is extended or adjusted under 35 U.S.C. 154(b) by 250 days.

(21) Appl. No.: 10/004,044

(22) Filed: Oct. 24, 2001

(65) Prior Publication Data

US 2003/0075855 A1 Apr. 24, 2003

(51) Int. Cl.[7] ..... B65H 3/10
(52) U.S. Cl. ..... 271/96; 271/94
(58) Field of Search ..... 271/112, 94, 96, 271/108, 99, 12

(56) References Cited

U.S. PATENT DOCUMENTS

| | | | | | |
|---|---|---|---|---|---|
| 604,892 | A | * | 5/1898 | Blaisdell | 271/94 |
| 2,033,849 | A | * | 3/1936 | Mudd | 271/94 |
| 2,812,178 | A | | 11/1957 | Hagren | 271/29 |
| 3,005,565 | A | * | 10/1961 | Daone et al. | 156/571 |
| 3,148,876 | A | * | 9/1964 | Chandler et al. | 271/12 |
| 3,372,924 | A | * | 3/1968 | Treff | 271/96 |
| 3,533,618 | A | | 10/1970 | Carstens | |
| 3,851,871 | A | | 12/1974 | Aronson | 271/11 |
| 3,976,291 | A | * | 8/1976 | Bernardi et al. | 271/94 |
| 4,184,670 | A | * | 1/1980 | Rosendahl | 271/12 |
| 4,260,146 | A | | 4/1981 | Mitzel | 271/94 |
| 4,269,405 | A | | 5/1981 | Mitzel | 271/94 |
| 4,320,893 | A | | 3/1982 | Blumle | 271/94 |
| 4,345,751 | A | * | 8/1982 | Holzhauser | 271/3.07 |
| 4,345,752 | A | * | 8/1982 | Nakamura et al. | 271/12 |
| 4,462,745 | A | * | 7/1984 | Johnson et al. | 414/798.9 |
| 4,511,133 | A | * | 4/1985 | Kokubo et al. | 271/3.08 |
| RE32,128 | E | | 4/1986 | Blumle | 271/94 |
| 4,579,330 | A | | 4/1986 | Lehmann | 271/11 |
| 4,739,982 | A | | 4/1988 | Hain | 271/94 |
| 4,787,619 | A | | 11/1988 | Fuss et al. | 271/98 |
| 4,789,148 | A | | 12/1988 | Noguchi et al. | 271/94 |
| 4,838,982 | A | * | 6/1989 | Klaeser et al. | 156/520 |
| 5,029,834 | A | * | 7/1991 | Boldrini et al. | 271/11 |

(List continued on next page.)

FOREIGN PATENT DOCUMENTS

| | | | | |
|---|---|---|---|---|
| EP | 004 7937 | | 4/1984 | B65H/3/10 |
| EP | 001 7983 | | 7/1984 | B65H/3/10 |
| EP | 413471 | * | 2/1991 | B65H/3/10 |
| EP | 562580 | * | 9/1993 | B65H/3/06 |
| JP | 56-23143 | * | 3/1981 | 271/94 |
| JP | 56-61243 | * | 5/1981 | 271/94 |
| JP | 62-14093 | * | 6/1987 | 271/94 |
| JP | 63-66043 | * | 3/1988 | 271/94 |
| JP | 1-317930 | * | 12/1989 | 271/94 |
| JP | 403079525 | | 4/1991 | |

*Primary Examiner*—Donald P. Walsh
*Assistant Examiner*—Daniel K Schlak
(74) *Attorney, Agent, or Firm*—Michael J. Cummings; Charles R. Malandra, Jr.; Angelo N. Chaclas

(57) ABSTRACT

A rotatable pneumatic feeding head having a vacuum shoe with apertures for picking up an envelope from an envelope stack by negative air pressure. The feeding head has an outer cylinder with holes communicating with the apertures, and an inner cylinder with cutout regions operatively connected to a vacuum pump. The inner cylinder and the outer cylinder are rotated independently of each other such that when they are aligned, a negative pressure is created at the apertures through the cutout regions and the holes. When the inner cylinder and the outer cylinder are out of alignment, the negative pressure is cut off from the apertures. The vacuum shoe is removable so that it can be repaired or replaced when it is damaged or worn.

9 Claims, 7 Drawing Sheets

U.S. PATENT DOCUMENTS

| | | | | | |
|---|---|---|---|---|---|
| 5,072,922 | A | | 12/1991 | Paulson | 271/11 |
| 5,078,381 | A | | 1/1992 | Brabant et al. | 271/99 |
| 5,088,717 | A | | 2/1992 | Hamanaka et al. | 271/98 |
| 5,374,044 | A | | 12/1994 | Belec et al. | 271/2 |
| 5,415,068 | A | | 5/1995 | Marzullo et al. | 53/492 |
| 5,417,158 | A | | 5/1995 | Parsio | 271/99 X |
| 5,421,699 | A | | 6/1995 | Guiles et al. | 414/788 |
| 5,441,248 | A | * | 8/1995 | Kristola | 271/12 |
| 5,447,015 | A | | 9/1995 | Belec et al. | 53/492 |
| 5,642,878 | A | | 7/1997 | Smithe et al. | 271/109 |
| 5,704,607 | A | * | 1/1998 | Brotherston | 271/96 |
| 5,813,669 | A | * | 9/1998 | Horii | 271/12 |
| 6,053,492 | A | * | 4/2000 | Newsome | 271/94 |
| 6,068,253 | A | * | 5/2000 | Mueller et al. | 271/94 |
| 6,095,513 | A | | 8/2000 | Wright | 271/94 |
| 6,446,955 | B1 | * | 9/2002 | Janatka et al. | 271/96 |
| 6,588,580 | B2 | * | 7/2003 | Janzen | 198/689.1 |
| 2004/0075209 | A1 | * | 4/2004 | Horiuchi | 271/98 |

* cited by examiner

PNEUMATIC APPARATUS WITH REMOVABLE VACUUM SHOE

CROSS REFERENCE TO RELATED APPLICATIONS

Reference is made to pending application Ser. No. 09/648,578, entitled METHOD AND APPARATUS FOR FEEDING ENVELOPES, assigned to the assignee of this application and filed on Aug. 28, 2000.

TECHNICAL FIELD

The present invention relates to an envelope supply device and, more particularly, to an envelope feeder in an envelope insertion machine.

BACKGROUND OF THE INVENTION

In a typical envelope insertion machine for mass mailing, enclosure materials are gathered in a gathering section and moved toward an inserting station where the enclosure materials are inserted into an envelope. Envelopes are separately fed to the inserting station and each envelope is placed on a platform with its flap flipped back all the way for insertion. Before envelopes are fed to the insertion station, they are usually supplied in a stack in a supply tray. Envelopes are then separated by an envelope feeder so that only one envelope at a time is moved into the inserting station. In a high-speed insertion machine, the feeder should be able to feed single envelopes at a rate of approximately 18,000 #10 envelopes per hour. At this feeding rate, it is critical that only a single envelope at a time is picked up and delivered to the insertion station.

In the past, as in the envelope feeder disclosed in U.S. Pat. No. 5,415,068 (Marzullo), envelopes are singulated by using a belt to transport the last envelope in a stack to move downstream. If one or more envelopes move along with the last envelope, it will be stopped by a mechanical retarder which provides a friction force against the moving envelope. In the envelope feeder, as disclosed in Marzullo, the envelopes are stacked vertically and the bottom of the stack is spring-loaded to allow envelopes to be separated from the top of the stack. This type of envelope feeder requires adjustments to be made to the envelope feeder or the envelope transport. Thus, while this type of top-separation design can eliminate some of the problems usually associated with pack pressure on units that rely on gravity to deliver the envelopes toward the separating device, envelope restocking is very inconvenient.

Thus, it is advantageous and desirable to provide an envelope feeder that can deliver individual envelopes at a high feeding rate and, at the same time, eliminate the above-mentioned problems and inconvenience.

SUMMARY OF THE INVENTION

According to the first aspect of the present invention, a vacuum shoe for use in a rotatable pneumatic apparatus for retrieving an item at a pickup point, wherein the pneumatic apparatus comprises an inner cylinder having an outer periphery with a least one cutout region formed therein, the inner cylinder further having an air passageway communicating with said at least one cutout region and with an air pressure device so as to provide a negative pressure to said at least one cutout region; and an outer cylinder concentrically mounted on the outer periphery of the inner cylinder for rotation, wherein the outer cylinder comprises at least one opening communicable with said at least one cutout region when said at least one opening is adjacent the pickup point while the outer cylinder is rotated relative to the inner cylinder. The vacuum shoe comprises:

- a securing mechanism for removably mounting the vacuum shoe on an outer surface of the outer cylinder; and
- at least one aperture communicable with said at least one opening, such that when said at least one opening of the outer cylinder is adjacent the pickup point, the negative pressure at the aperture causes the item to become attached to the vacuum shoe, allowing the pneumatic apparatus to move said item away from the pickup point.

According to the second aspect of the present invention, a rotatable pneumatic apparatus for retrieving an item at a pickup point. The pneumatic apparatus comprising:

- an inner cylinder having an outer periphery with a least one cutout region formed therein, the inner cylinder further having an air passageway communicating with said at least one cutout region and with an air pressure device so as to provide a negative pressure to said at least one cutout region;
- an outer cylinder concentrically mounted on the outer periphery of the inner cylinder for rotation, wherein the outer cylinder comprises at least one opening communicable with said at least one cutout region of the inner cylinder when said at least one opening is adjacent the pickup point while the outer cylinder is rotated relative to the inner cylinder;
- a vacuum shoe positioned on an outer surface of the outer cylinder, the vacuum shoe having at least one aperture communicable with said at least one opening of the outer cylinder, such that when said at least one opening of the outer cylinder is adjacent the pickup point, the negative pressure at the aperture causes said item to become attached to the vacuum shoe, allowing the pneumatic apparatus to move said item away from the pickup point; and
- a securing mechanism for removably securing the vacuum shoe to the outer cylinder, allowing the vacuum shoe to be removed from the pneumatic apparatus for maintenance or replacement.

Preferably, the inner cylinder is rotated independently of the outer cylinder such that when said at least one opening of the outer cylinder is rotated to a releasing point, said at least one cutout region of the inner cylinder becomes off-aligned with said at least one opening for reducing the negative pressure at the aperture of the vacuum shoe so as to allow said item to be released from the vacuum shoe at the releasing point.

Preferably, the outer cylinder is rotated along one direction, and the inner cylinder is rotated alternatively along the same direction and along an opposite direction in an oscillating motion such that said at least one cutout region of the inner cylinder alternately becomes aligned with said at least one opening of the outer cylinder for providing the negative pressure at the aperture of the vacuum shoe, and becomes off-aligned with the said at least one opening of the outer cylinder for reducing the negative pressure at the aperture of the vacuum shoe.

According to the third aspect of the present invention, an envelope feeder for feeding envelopes at a pickup point, which comprises:

- a deck for supporting a stack of the envelopes;
- a rotatable pneumatic feeding head for retrieving one envelope at a time from the stack, wherein the feeding head comprises an inner cylinder having an outer periphery with at least one cutout region formed therein, the inner cylinder further having an air passageway communicating with said at least one cutout region and with an air pressure device so as to provide a negative pressure to said at least one cutout region; an outer cylinder concentrically mounted on the outer periphery of the inner cylinder for rotation, wherein the outer cylinder comprises at least one opening communicable with said at least one cutout region when said at least one opening is adjacent the pickup point while the outer cylinder is rotated relative to the inner cylinder; a vacuum shoe positioned on an outer surface of the outer cylinder, the vacuum shoe having at least one aperture communicable with said at least one opening of the outer cylinder, such that when said at least one opening of the outer cylinder is adjacent the pickup point, the negative pressure at the aperture causes said envelope to become attached to the vacuum shoe, allowing the pneumatic apparatus to move said envelope away from the pickup point; and a securing mechanism for removably securing the vacuum shoe to the outer cylinder, allowing the vacuum shoe to be removed from the pneumatic apparatus for maintenance or replacement, and a rotating mechanism, operatively connected to the feeding head, for rotating the outer cylinder relative to the inner cylinder.

Preferably, the inner cylinder is rotated independently of the outer cylinder such that when said at least one opening of the outer cylinder is rotated to a releasing point, said at least one cutout region of the inner cylinder becomes off-aligned with said at least one opening for reducing the negative pressure at the aperture of the vacuum shoe so as to allow said envelope to be released from the vacuum shoe at the releasing point.

Preferably, the outer cylinder is rotated along one direction, and the inner cylinder is rotated alternatively along the same direction and along an opposite direction in an oscillating motion such that said at least one cutout region of the inner cylinder alternately becomes aligned with said at least one opening of the outer cylinder for providing the negative pressure at the aperture of the vacuum shoe, and becomes off-aligned with the said at least one opening of the outer cylinder for reducing the negative pressure at the aperture of the vacuum shoe.

According to the present invention, the envelope feeder also comprises a strip-away plate located adjacent to the feed head for stripping away said envelope from the vacuum shoe, and a pair of take away rollers for further moving said envelope from the releasing point.

The present invention will become apparent upon reading the description taking in conjunction with FIGS. 1 to 5E.

DETAILED DESCRIPTION

Figure 1:
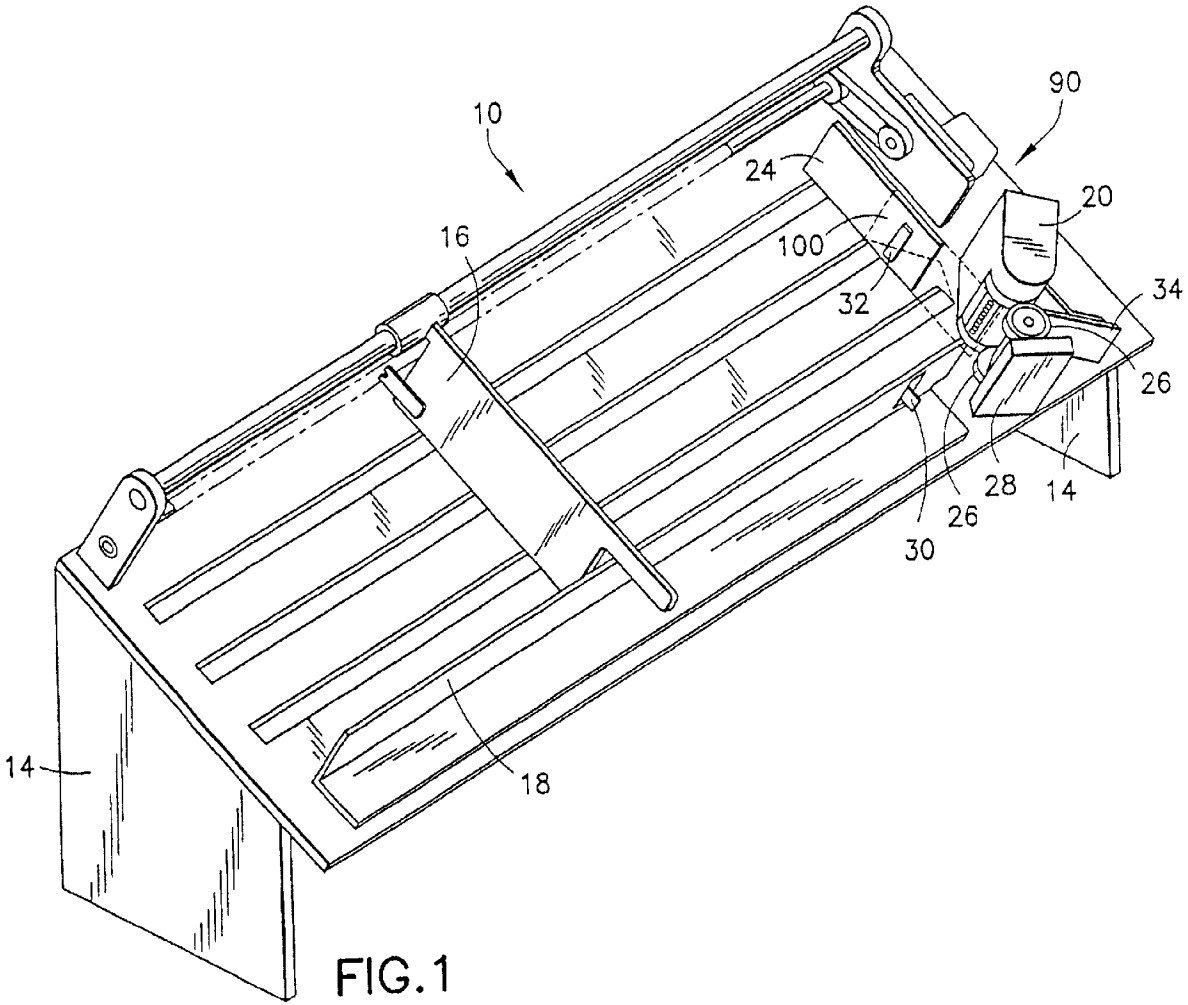
FIG. 1 is an isometric view showing the envelope supply device, according to the present invention.

FIG. 1 illustrates an isometric view of an envelope supply device 10, which is a part of an envelope insertion machine (not shown). As shown in FIG. 1, the envelope supply device 10 includes a feed tray, or main deck 12, a pair of deck supports 14, a pusher back paddle 16, a lead edge deck 18 and a pneumatic feeding head 20. The pneumatic feeding head 20 is located at one corner of the downstream end 90 of the envelope supply device 10. Envelopes are stacked into a stack (not shown) between the pneumatic apparatus 20 and the pusher back paddle 16. The envelope stack is constantly pushed by the pusher back paddle 16 toward the downstream end 90 so that the envelope supply device 10 will have an adequate supply of envelopes for feeding. One of the envelopes is shown in dashed lines and denoted by numeral 100. Each envelope of the stack is vertically oriented, with one of the long edges touching the main deck surface, and one of the side edges aligned against the lead edge deck 18, which is substantially perpendicular to the surface of the main deck 12. The side edge that is aligned against the lead edge deck 18 is referred to as the lead edge of the envelope. It is preferred that the envelopes are stacked upside down with the crease line (top long edge) touching the deck surface, and the flap closed and facing the pusher back paddle 16. It is also preferred that the main deck 12 is tilted at an angle $\alpha$ from the horizontal plane such that the long edges of the envelopes are also substantially tilted at the same angle $\alpha$ from the horizontal plane. The tilt angle $\alpha$ can range from 5 to 45 degrees, but, preferably, about 30 degrees. With the main deck 12 being tilted at an angle, the envelopes in the stack are pulled towards the lead edge deck 18 by gravity. As such, all the envelopes are justified at the lead edge regardless of the envelope size. Thus, the tilting of the main deck substantially eliminates the requirement to adjust the envelope supply device 10 in order to accommodate envelopes of different sizes. At the downstream end 90 of the main deck 12, a stop fence 24 is used to stop the approaching envelopes. As described later in conjunction with FIGS. 2 and 5A–5E, the pneumatic apparatus 20 uses a negative air pressure to pick up or retrieve the envelopes 100, one at the time, from the envelope stack. After picking up the envelope, the pneumatic apparatus 20 is rotated toward a pair of take-away rollers 26 so that the envelope picked up by the pneumatic apparatus 20 can be moved away from the pneumatic apparatus 20 and the envelope stack. As shown, the take-away rollers 26 are mounted on a roller mount 28. Also shown in FIG. 1 is a separator plate 30, movably mounted on the lead edge deck 18. The separator plate 30 is used to adjust the gap between the envelope stack and the pneumatic apparatus 20, as shown in FIGS. 5A–5E, to prevent more than one envelope from being taken away at a time from the envelope stack by the pneumatic apparatus 20 and the take-away rollers 26. It is also preferred that a strip-away plate 34 is used to strip the retrieved envelope from the pneumatic apparatus 20, as shown in FIG. 5E. As shown in FIG. 1, an envelope sensor 32 located on the stop fence 24 is used to alert an operator when the envelope supply is low or depleted.

Figure 2:
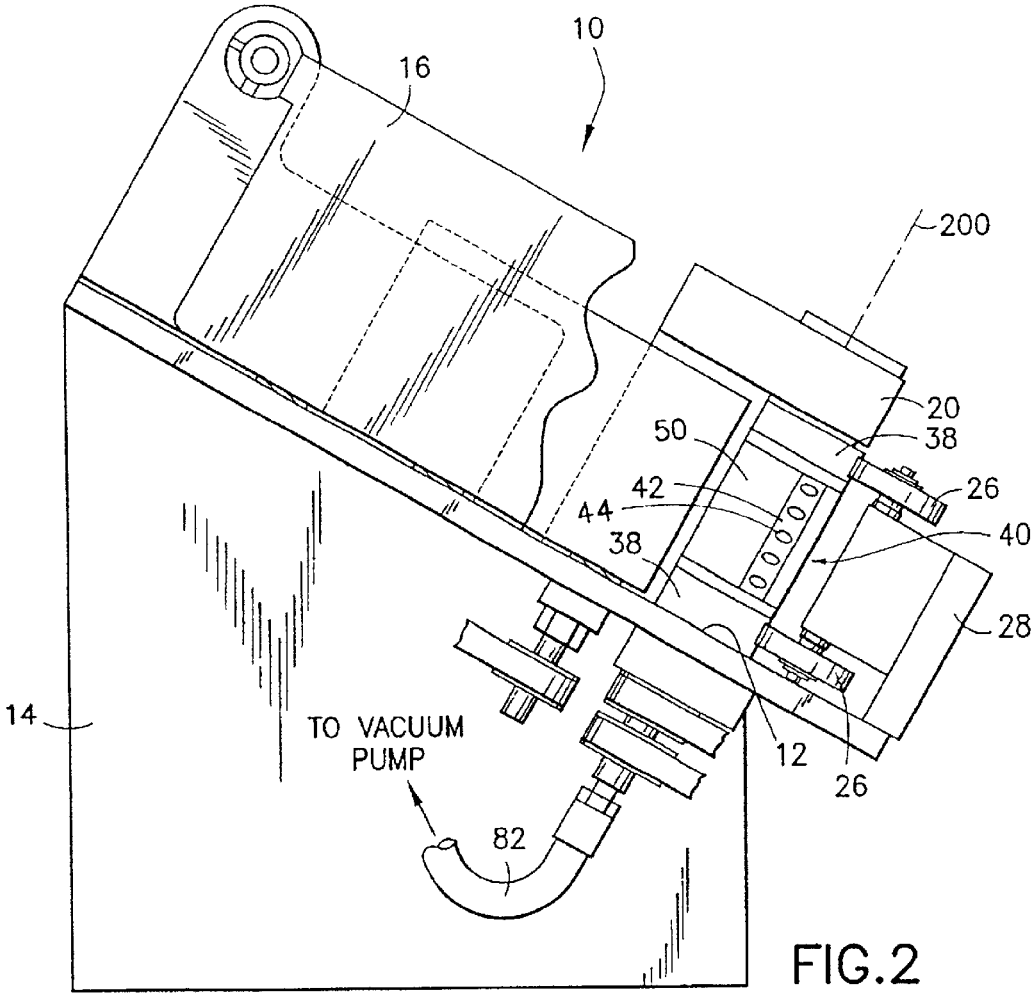
FIG. 2 is an isometric view showing the pneumatic feeding head.

FIG. 2 illustrates an isometric view of pneumatic apparatus 20. As shown, the pneumatic apparatus 20 includes a feeding head 40 which can be rotated about an axis 200 which is substantially perpendicular to the surface of the main deck 12. The feeding head 40 comprises an outer cylinder 50 on which a vacuum shoe 42 having a row of apertures 44 is removably mounted. The apertures 44 are used to provide the suction force necessary to pick up the lead edge of an envelope 100, as shown in FIGS. 5B and 5C. The suction force is produced by pumping air out of the feeding head 40 through an air conduit 82 thereby creating a vacuum or a negative air pressure at the aperture 44. Air is pumped out by a vacuum pump in a manner known in the art. The vacuum pump is not shown in FIG. 2. When the feeding head 40 is rotated such that the apertures 44 are located near the envelope stack 102 (FIGS. 5A–5E), the negative air pressure at the apertures 44 draws the lead edge of the outer-most envelope 100 of the envelope stack 102 towards the vacuum shoe 42, causing the envelope to become attached to the feeding head 40, as shown in FIG. 5B. As the feeding head 40 continues to rotate, as shown in FIGS. 5C and 5D, it moves the attached envelope 100 toward the take-away rollers 26 so as to allow the take-away rollers 26 to move the envelope 100 away from the pickup point 150. The attached envelope 100 is then stripped off from the feeding head 40 by a strip-away plate 34 and the envelope is moved further away by the take-away rollers 26. Also shown in FIG. 2 are two inner rollers 38, each of which is used to form a take-away nip with a respective take-away rollers 26.

It is preferred, however, that the feeding head 40 also comprises an inner cylinder 60 which can be rotated independently of the outer cylinder 50, as shown in FIGS. 5A through 5E. The outer cylinder 50 has a number of openings 52 communicating with the apertures 44 of the vacuum shoe 42. The inner cylinder 60 has an outer periphery 62 surrounding an inner hollow core 80, which communicates with the air conduit 82. The outer periphery 62 of the inner cylinder 60 has one or more cutout sections 64. As air is pumped out from the inner core 80 and the cutout sections 64 of the inner cylinder 60 via the air conduit 82, a negative air pressure is provided to the apertures 44 when the cutout sections 64 of the inner cylinder 60 are aligned with the openings 52 of the outer cylinder 50. Thus, when the inner cylinder 60 and the outer cylinder 50 are in an aligned position, the apertures 44 are operatively connected to the vacuum pump via the air conduit 82. However, when the inner cylinder 60 and the outer cylinder 50 are completely out of alignment, the negative air pressure is not provided to the apertures 44 through the cutout sections 64. In this respect, the inner cylinder 60 is used as an air valve, which can turn on or off the negative air pressure at the apertures 44 of the vacuum shoe 42. Accordingly, when the inner cylinder 60 and the outer cylinder 50 are not in the aligned position, the apertures 44 are operatively disconnected from the vacuum pump.

Figure 3:
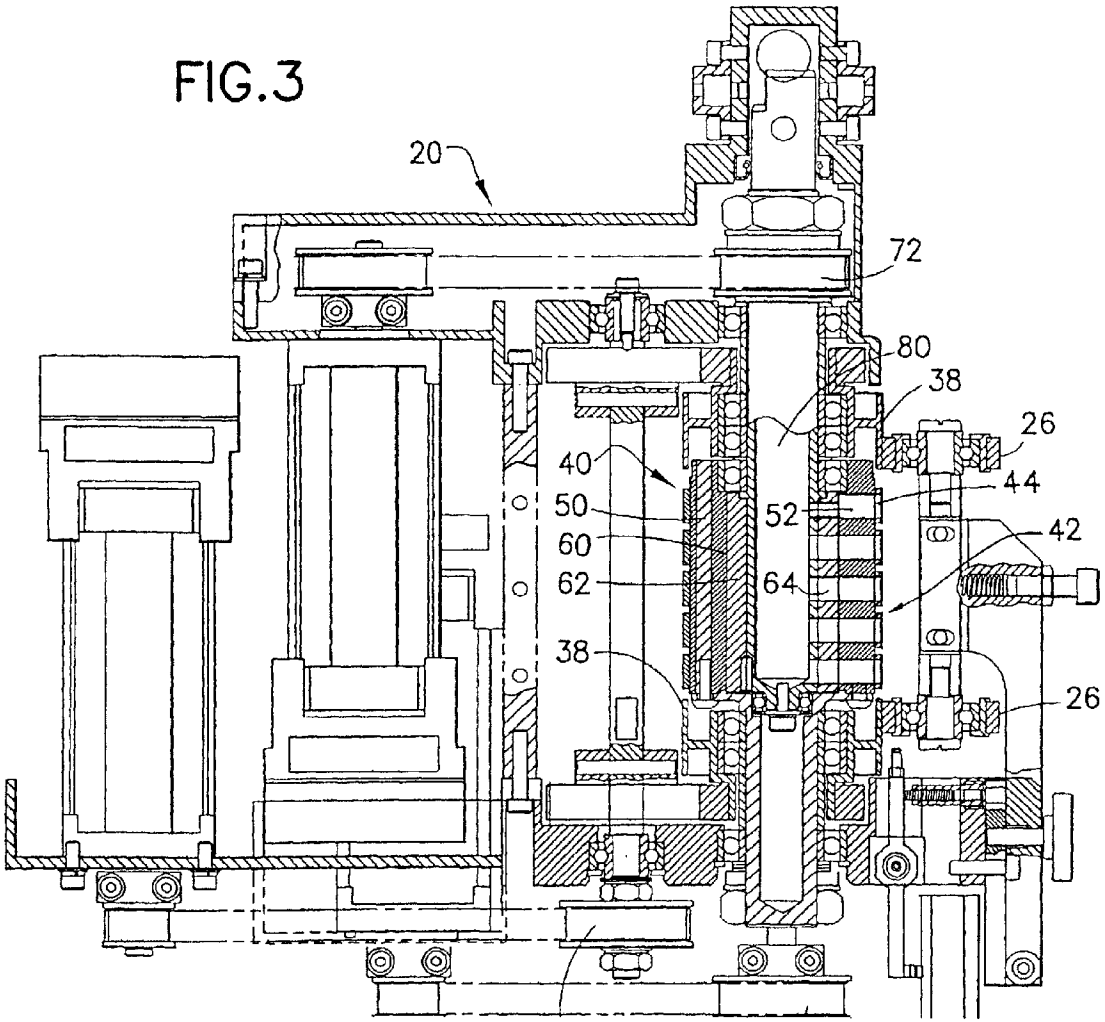
FIG. 3 is a cross sectional view of the pneumatic feeding head.

Also shown in FIG. 3 are various movement devices: pulley 70 is used to rotate the outer cylinder 50; pulley 72 is used to rotate the inner cylinder 60; and pulley 74 is used to drive the inner rollers 38 and take-away rollers 26.

Figure 4:
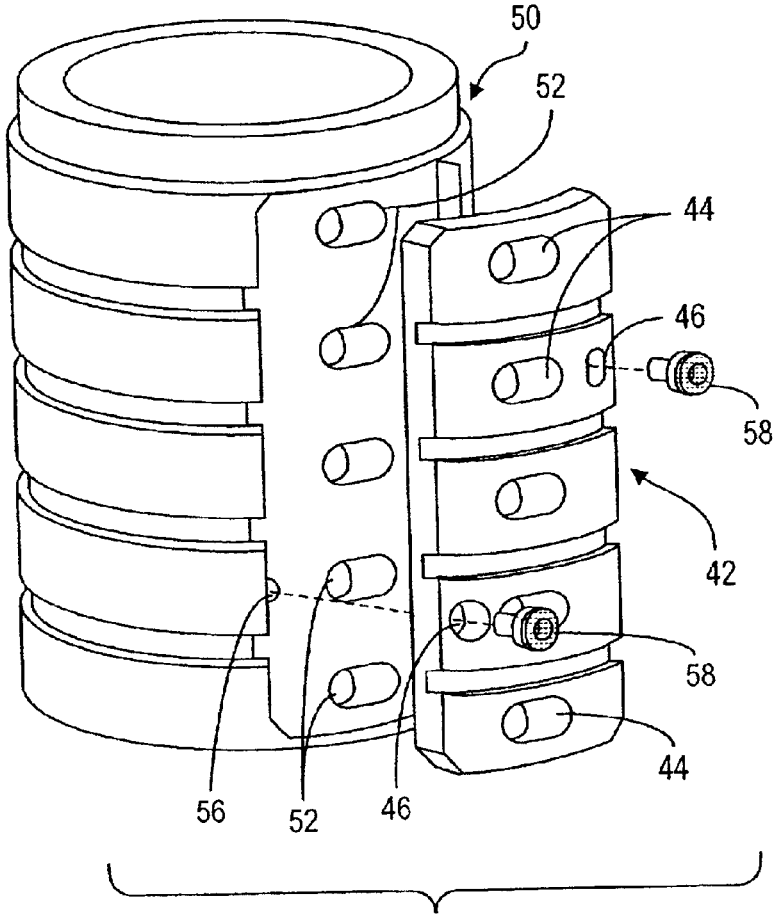
FIG. 4 is an exploded view showing the replaceable vacuum shoe in relation with the outer cylinder of the pneumatic feeding head.

As the vacuum shoe 42 is used to pick up envelopes by negative air pressure at the apertures 44 at a high rate, the envelopes can damage the shoe surface after a certain period of feeding operation. Thus, it is desirable that the vacuum shoe 42 can be removable from the feeding head 40 so the damaged shoe surface may be repaired, or a new vacuum shoe may be used to replace the damaged one. As shown in FIG. 4, the vacuum shoe 42 has two mounting holes 46 and the outer cylinders have two threaded holes 56 so that the vacuum shoe 42 can be secured to the outer cylinder 50 by bolts 58. As such, the vacuum shoe 42 can be removed from the outer cylinder 50 if so desired. As shown in FIG. 4, the apertures 44 on the vacuum shoe 42 are aligned with the openings 52 of the outer cylinder 50.

FIGS. 5A through 5E illustrate the principle of envelope feeding using the feeding head 40, which has an inner cylinder 60 and an outer cylinder 50. Because the apertures 44 and the openings 52 are always aligned as the vacuum shoe 42 is securely mounted on the outer cylinder 50 by the bolts 58, only the apertures 44 are shown in FIGS. 5A–5E. For clarity, the vacuum shoe 42 and the openings 52 are not shown. When the inner cylinder 60 and the outer cylinder 50 are aligned, the cutout regions 64 in the outer periphery 62 of the inner cylinder 60 communicate with the apertures 44.

Figure 5A:
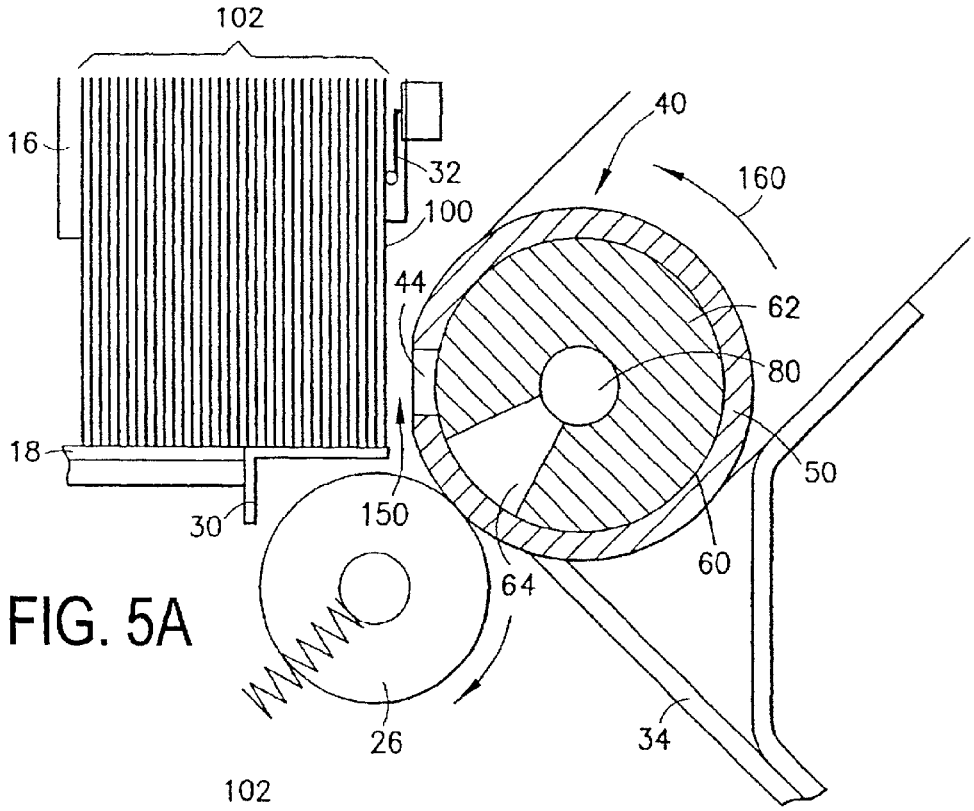
FIG. 5A is a diagrammatic representation illustrating the outer cylinder being positioned at the pickup point prior to picking up an envelope.
Figure 5B:
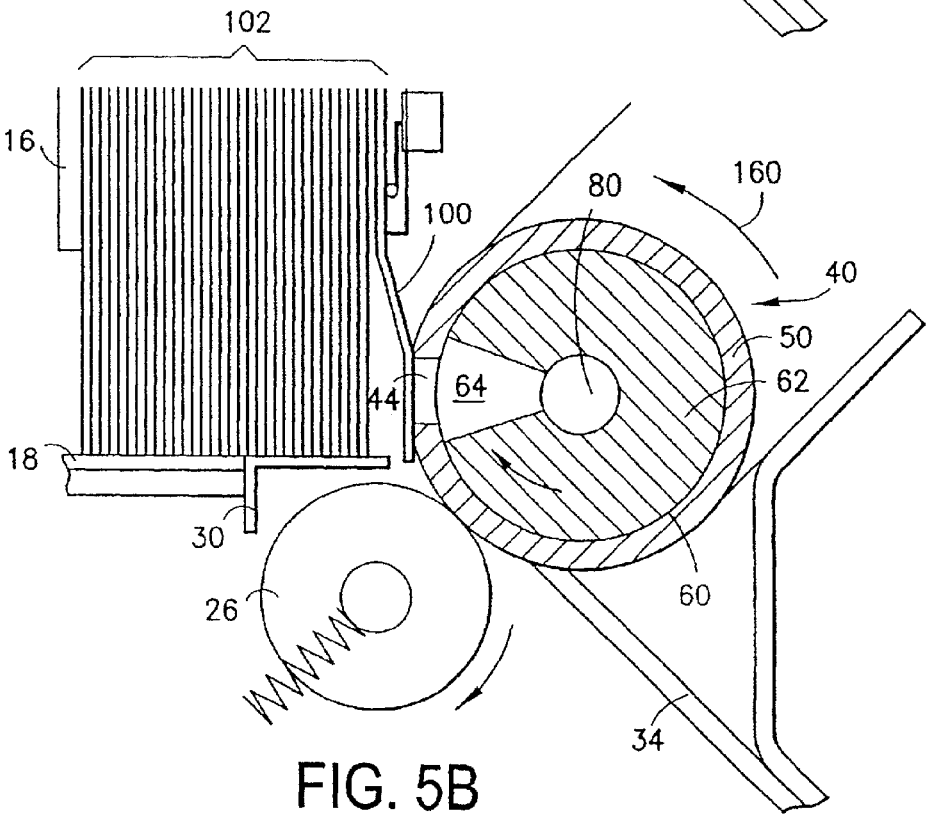
FIG. 5B is a diagrammatic representation illustrating an envelope being attached to the feeding head by the negative pressure.
Figure 5C:
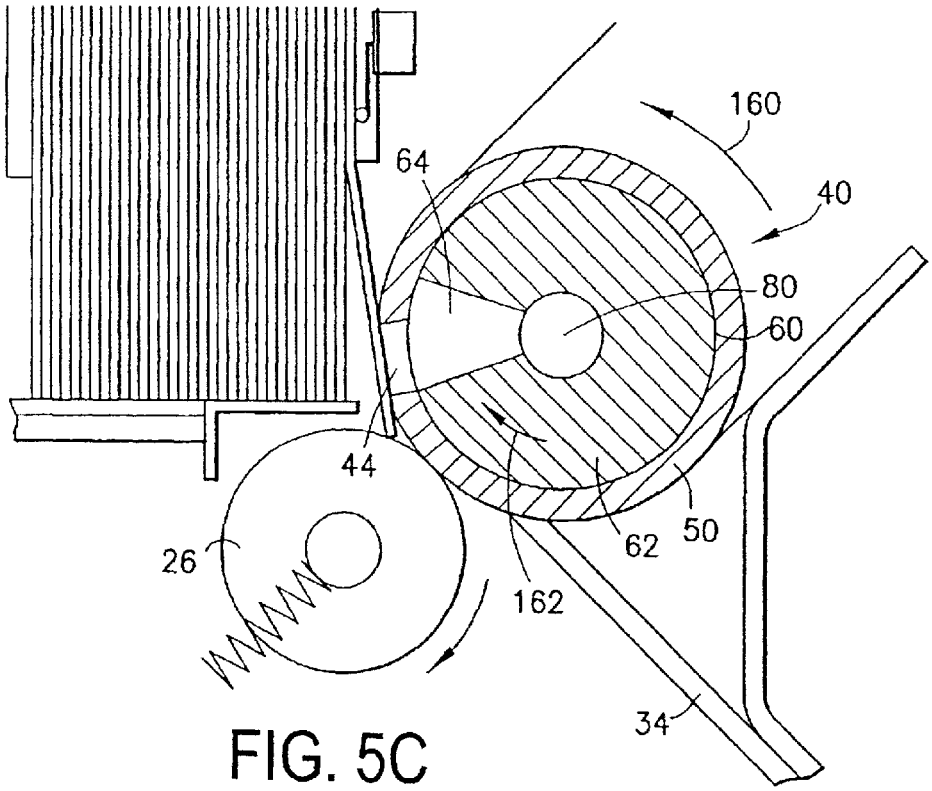
FIG. 5C is a diagrammatic representation illustrating the attached envelope being moved away from the pickup point.
Figure 5D:
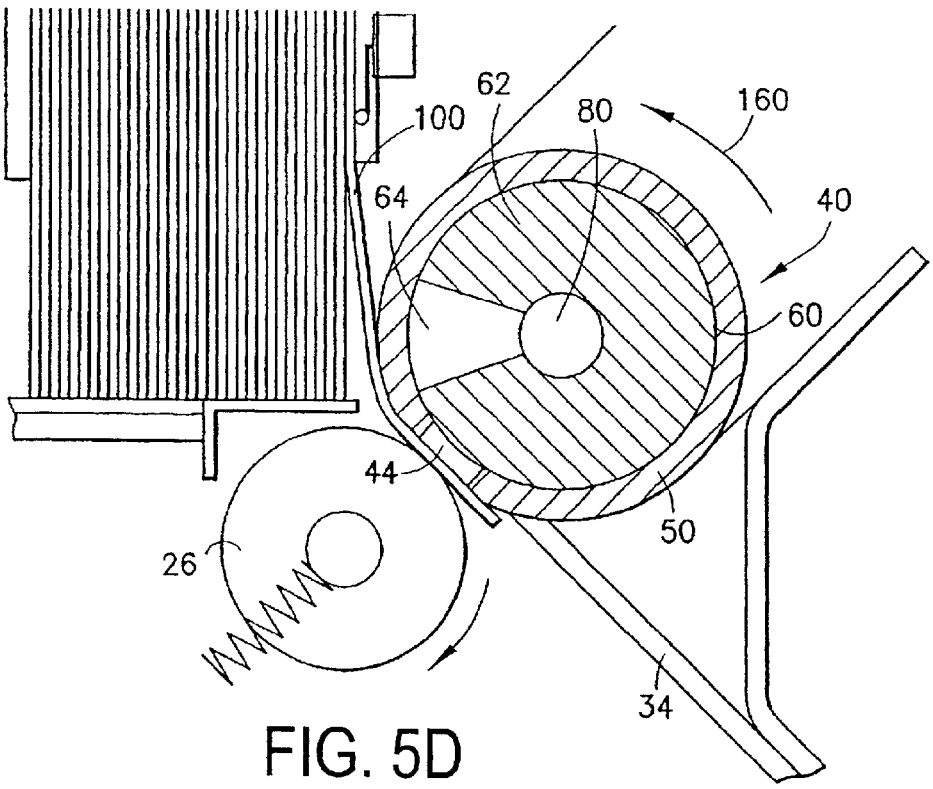
FIG. 5D is a diagrammatic representation illustrating the attached enveloped being engaged with a nip.
Figure 5E:
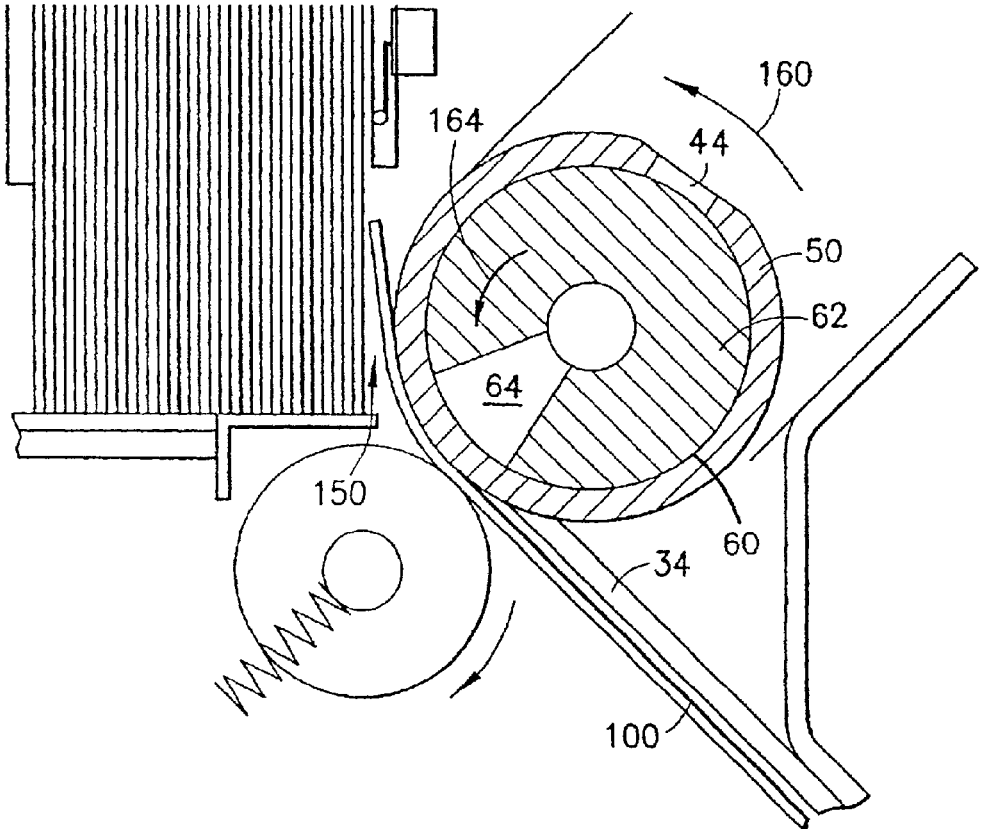
FIG. 5E is a diagrammatic representation illustrating the envelope being carried away by the nip while the outer cylinder is moving toward the initial position.

FIG. 5A shows an initial position of the outer cylinder 50 in an envelope feeding cycle. As shown, while the apertures 44 are positioned at the pickup point 150, the cutout sections 64 of the inner cylinder 60 are not aligned with the apertures 44. Therefore, the apertures 44 are operatively disconnected from the vacuum pump, and the feeding head 40 has no effect on the outer-most envelope 100 of the envelope stack 102.

When the inner cylinder 60 is rotated relative to the outer cylinder 50 such that the cutout sections 62 of the inner cylinder 60 are aligned with the apertures 44, as shown in FIG. 5B, the apertures 44 are operatively connected to the vacuum pump via the inner core 80 of the inner cylinder 60. The negative air pressure at the apertures 44 draws the lead edge of the envelope 100 towards the feeding head 40 and causes the envelope 100 to become attached to the feeding head 40. The opposing motion of the outer cylinder 50 and the inner cylinder 60 creates a very sharp negative pressure (or vacuum burst) as cutout section 64 of the inner cylinder 60 comes into alignment with apertures 44 in a scissor-like action. As cutout section 64 and apertures 44 slide into alignment from opposing directions, the sudden vacuum burst created by the alignment has been found to be highly effective in successfully drawing the envelope 100 to the feeding head 40.

As shown in FIG. 5C, the outer cylinder 50 continues to rotate in a counter-clockwise direction, as indicated by arrow 160, and the outer cylinder 50 brings the attached envelope 100 into contact with the take-away rollers 26. At the same time, the inner cylinder 60 is rotated in a clockwise direction. As soon as the envelope 100 picked up by the outer cylinder 50 is taken away by the take-away rollers 26, the negative air pressure at the openings 52 is no longer needed. The point where the envelope 100 is taken away by the take-away rollers 26 is referred to as the releasing point. Thus, it is preferred that as soon as the envelope 100 picked up by the outer cylinder 50 reaches the releasing point where the envelope 100 is taken over by the take-away rollers 26, the outer cylinder 50 and the inner cylinder 60 are completely out of alignment so that the cutout sections 64 of the inner cylinder 60 are not in a communication position with the apertures 44, as shown in FIG. 5D. The opposing motion of outer cylinder 50 and inner cylinder 60 limits reduction in vacuum capacitance by more sharply and quickly disengaging the vacuum source from apertures 44. The apertures 44 are now operatively disconnected from the vacuum pump. This allows the vacuum in the inner core 80, the cutout sections 64 and the air conduit 82 to be properly re-established. At the same time, the envelope 100 is no longer pneumatically attached to the feeding head 40 by the negative pressure from the vacuum source at the apertures 44.

As shown in FIG. 5E, the envelope 100 picked up by the feeding head 40 is stripped away from the feeding head 40 by a strip-away plate 34, effectively releasing the envelope 100 from the feeding head 40. As the outer cylinder 50 continues to move in the counter-clockwise direction 160, in order to position the apertures 44 at the pickup point 150, the inner cylinder 60 is rotated along the same direction, as indicated by arrow 164, effectively keeping the cutout sections 62 away from the pickup point 150. The envelope feeding cycle repeats itself as the feeding head 40 comes back to the position shown in FIG. 5A.

In performing the envelope feeding cycle described herein, it is preferred that the outer cylinder 50, inner cylinder 60, and takeaway roller 26 be independently controllable. Such independent control allows flexibility for improving the efficiency and reliability of the feeding operation. Preferably, such independent control can be achieved by driving the components with separately controlled servo motors. For example, instead of takeaway roller 26 at a constant rate, it can run at a variable speed in order to ramp up the speed of the envelope as it is being removed from the stack, in order to perform a cleaner hand-off to a downstream drive element. Inner and outer cylinders 50 and 60 may also be electronically geared to each other for part of the feed cycle. If desired, the relative motion of the components could be adjusted to modify the vacuum profile experienced by a fed envelope so that it can be released earlier or later, as may be appropriate for different operating conditions. Also, if there is a problem with an original attempt to feed an envelope, the component controls can be programmed with a motion profile to perform a refeed within the same cycle.

In general, the surface of the vacuum shoe 42 must withstand very high speed action. At the same time, the surface must have sufficient friction to help carry the attached envelope away from the pickup point. Accordingly, the surface finish of the vacuum shoe 42 may vary with the types, sizes and weights of the envelopes to be fed.

Thus, the present invention has been disclosed in the preferred embodiment thereof. It should be understood by those skilled in the art that the foregoing and various other changes, omissions and deviations in the form and detail thereof may be made without departing from the spirit and the scope of this invention.

What is claimed is:

1. A rotatable pneumatic apparatus for retrieving an item at a pickup point, said pneumatic apparatus comprising:

an inner cylinder having an outer periphery with at least one cutout region formed therein, the inner cylinder further having an air passageway communicating with said at least one cutout region and with an air pressure device so as to provide a negative pressure to said at least one cutout region;

an outer cylinder concentrically mounted on the outer periphery of the inner cylinder for rotation, wherein the outer cylinder comprises at least one opening communicable with said at least one cutout region of the inner cylinder when said at least one opening is adjacent the pickup point while the outer cylinder is rotated relative to the inner cylinder;

a vacuum shoe positioned on an outer surface of the outer cylinder, the vacuum shoe having at least one aperture communicable with said at least one opening of the outer cylinder, such that when said at least one opening of the cylinder is adjacent the pickup point, the negative pressure at the aperture causes said item to become attached to the vacuum shoe, allowing the pneumatic apparatus to move said item away from the pickup point: and means for removably securing the vacuum shoe to the outer cylinder, allowing the vacuum shoe to be removed from the pneumatic apparatus for maintenance or replacement; independently of the outer cylinder such that when said at least one opening of the outer cylinder is rotated to a releasing point, said at least one cutout region of the inner cylinder becomes off-aligned with said at east one opening for reducing the negative pressure at the aperture of the vacuum shoe so as to allow said item to be released from the vacuum shoe at the releasing point.

2. The rotatable pneumatic apparatus of claim 1, wherein the outer cylinder is rotated along one direction, and the inner cylinder is rotated alternatively along the same direction and along an opposite direction in an oscillating motion such that said at least one cutout region of the inner cylinder alternately becomes aligned with said at least one opening of the outer cylinder for providing the negative pressure at the aperture of the vacuum shoe, and becomes off-aligned with the said at least one opening of the outer cylinder for reducing the negative pressure at the aperture of the vacuum shoe.

3. An envelope feeder for feeding envelopes at a pickup point, comprising:

a deck for supporting a stack of the envelopes;

a rotatable pneumatic feeding head for retrieving one envelope at a time from the stack, wherein the feeding head comprises:

an inner cylinder having an outer periphery with a least one cutout region formed therein, the inner cylinder further having an air passageway communicating with said at least one cutout region and with an air pressure device so as to provide a negative pressure to said at least one cutout region;

an outer cylinder concentrically mounted on the outer periphery of the inner cylinder for rotation, wherein the outer cylinder comprises at least one opening communicable with said at least one cutout region when said at least one opening is adjacent the pickup point while the outer cylinder is rotated relative to the inner cylinder;

a vacuum shoe positioned on an outer surface of the outer cylinder, the vacuum shoe having at least one aperture communicable with said at least one opening of the outer cylinder, such that when said at least one opening of the outer cylinder is adjacent the pickup point, the negative pressure at the aperture causes said envelope to become attached to the vacuum shoe, allowing the pneumatic apparatus to move said envelope away from the pickup point; and means for removably securing the vacuum shoe to the outer cylinder, allowing the vacuum shoe to be removed from the pneumatic apparatus for maintenance or replacement, and means, operatively connected to the feeding head, for rotating the outer cylinder relative to the inner cylinder.

4. The envelope feeder of claim 3, wherein the inner cylinder is rotated independently of the outer cylinder such that when said at least one opening of the outer cylinder is rotated to a releasing point, said at least one cutout region of the inner cylinder becomes off-aligned with said at least one opening for reducing the negative pressure at the aperture of the vacuum shoe so as to allow said envelope to be released from the vacuum shoe at the releasing point.

5. The envelope feeder of claim 4, wherein the outer cylinder is rotated along one direction, and the inner cylinder is rotated alternatively along the same direction and along an opposite direction in an oscillating motion such that said at least one cutout region of the inner cylinder alternately becomes aligned with said at least one opening of the outer cylinder for providing the negative pressure at the aperture of the vacuum shoe, and becomes off-aligned with the said at least one opening of the outer cylinder for reducing the negative pressure at the aperture of the vacuum shoe.

6. The envelope feeder of claim 4, further comprising:

means, located at the releasing point, for moving said envelope from the feeding head as said envelope is released from the vacuum shoe.

7. The envelope feeder of claim 4, wherein the moving means comprising:

a plate located adjacent to the feed head for stripping away said envelope from the vacuum shoe, and a pair of rollers for further moving said envelope from the releasing point.

8. The envelope feeder of claim 6, wherein motion of the outer cylinder, the inner cylinder, and the means for moving said envelope from the feeding head are independently controllable.

9. The envelope feeder of claim 3, wherein the vacuum shoe has a plurality of mounting holes, and the outer cylinder has a plurality of threaded holes, each of the threaded holes communicating with a corresponding one of the mounting holes, and wherein the securing moans comprises a plurality of bolts for engaging with the threaded holes through the mounting holes of the vacuum shoe.

* * * * *